United States Patent [19]

Schank et al.

[11] 4,016,814

[45] Apr. 12, 1977

[54] PLANOGRAPHIC PRINTING MASTER

[75] Inventors: Richard L. Schank, Webster, N.Y.; Richard G. Crystal, Los Altos, Calif.

[73] Assignee: Xerox Corporation, Stamford, Conn.

[22] Filed: Apr. 13, 1973

[21] Appl. No.: 351,130

[52] U.S. Cl. ..... 101/467; 96/33; 96/36.3; 101/150; 101/401.1; 101/453; 427/262; 427/373; 427/387

[51] Int. Cl.[2] ..... B41N 1/14; B41C 1/10

[58] Field of Search ..... 101/455, 463, 465, 466, 101/467; 427/262, 373, 387; 96/33, 36.3

[56] References Cited

UNITED STATES PATENTS

| | | | |
|---|---|---|---|
| 2,692,827 | 10/1954 | Brinnick | 101/467 X |
| 2,910,351 | 10/1959 | Szpak et al. | 101/401.1 X |
| 3,093,478 | 6/1963 | Peterson et al. | 96/35 |
| 3,215,527 | 11/1965 | Johnson | 101/401.1 X |
| 3,246,148 | 4/1966 | De Troeyer et al. | 101/470 X |
| 3,368,483 | 2/1968 | Storms | 101/463 X |
| 3,391,637 | 7/1968 | Reynolds et al. | 101/401.3 |
| 3,644,014 | 2/1972 | Hirschberg | 346/76 R |
| 3,650,797 | 3/1972 | Tomanek | 101/463 X |
| 3,677,178 | 7/1972 | Gipe | 101/466 X |
| 3,682,633 | 8/1972 | Curtin | 101/463 X |
| 3,698,312 | 10/1972 | Muller | 101/465 X |
| 3,703,362 | 11/1972 | Dustin | 101/401.3 X |

FOREIGN PATENTS OR APPLICATIONS

| | | | |
|---|---|---|---|
| 1,004,237 | 9/1965 | United Kingdom | 101/395 |

OTHER PUBLICATIONS

The Journal of Photographic Science, vol. 18, No. 1, Jan.–Feb. 1970, pp. 4–7, Uhlig.

*Primary Examiner*—Clyde I. Coughenour
*Attorney, Agent, or Firm*—James J. Ralabate; James P. O'Sullivan; Donald M. MacKay

[57] ABSTRACT

A novel printing master and method for producing the same is disclosed which comprises the coating of a suitable substrate with an uncured silicone gum composition containing an activating proportion of a "blowing" or "foaming" agent. A particulate image pattern such as a toner image pattern, is transferred to the uncured silicone layer, followed by curing of the gum to an elastomeric ink releasable film. Activation of the "blowing" agent occurs during curing of the silicone to cause imagewise "foaming" of the silicone layer. After removal of the deposited image pattern, a "foamed" image is formed which is ink receptive and provides an imaged printing master suitable for use without a need for aqueous dampening solutions to provide ink release in non-imaged areas of the master.

14 Claims, 5 Drawing Figures

PLANOGRAPHIC PRINTING MASTER

BACKGROUND OF THE INVENTION

This invention relates to novel printing processes, particularly of the planographic type, to novel printing masters, method of forming these masters, as well as method of printing therefrom.

Conventional printing can be divided into broad process groups including relief printing, intaglio printing, and planographic printing. In relief printing, for example, the printing areas of the image carrier are raised above the plane of the substrate, which are then selectively inked for transfer to a copy sheet by direct impression. Intaglio printing involves substantially the reverse of this, in which printing areas are sunken in the image carrier, with nonprinting areas on the surface. The depressed printing areas carry applied ink which is removed in nonimage areas followed by transfer of the inked, depressed image to a copy sheet. Planographic printing is one of the better known types of printing and differs from either of the above two general types in that, printing and nonprinting areas are substantially in the same plane of the image carrier. Included within this type of printing are offset and direct lithography with the former depending on indirect image transfer from a carrier to a copy sheet, via a "blanket" or "impression" cylinder which rotates in contact with the image receiving surface and the image carrier, while the latter involves, as the term implies, direct transfer from the image carrier to the final copy or image receiving surface.

Direct lithography, while largely superseded commercially by offset lithography, has some advantages including usefulness in work where heavy ink films are essential, as well as a somewhat faster mode of operation than offset. However, because of direct contact between the image carrier and printing stock, abrasion of the image areas of lithographic plates can occur, thus life expectancy thereof is shortened, particularly if the "image" itself is relatively weak mechanically. Although it is now possible to obtain long production runs in direct lithography by means of bimetallic plates, on which the printing areas consist of one metal, and the nonprinting areas consist of a different metal, plates of this type did not exist during the time of most rapid growth of the printing industry and direct lithography, while of significant importance was therefore largely superseded by offset lithography.

In either the case of direct or offset lithography, a common denominator underlying either, is that printing and non-printing areas are essentially in the same plane on the image carrier, and that the nonimage areas must be chemically treated to be ink repellant, and further that ink repellance in the non-image areas must be maintained during printing by dampening the plate with a water "fountain" solution at every printing cycle. The process is thus dependent on the addition of a material such as water, which is mutually exclusive to an ink, to selective areas of the imaged plate, as well as the maintenance of a balance between ink and the water during the printing process.

Planographic plate making or the formation of the imaged master, can be accomplished in a variety of ways including using a metal substrate coated with a photosensitive layer, such as a diazo compound to form a negative or positive image of a photographically applied image, as well as bimetallic plates which once imaged with a photomechanical stencil, can be selectively etched, in image or nonimage areas to provide metals of preferential sensitization for either ink or water. A more recent innovation in the formation of planographic masters, involves the use of electrophotography or xerography to image the image carrier, in which case a latent electrostatic image is formed on the surface of a photoresponsive coating which is then developed with electroscopic toner particles to form a powder image. The developed, powder image can be then transferred to an aluminum substrate and fused thereon to provide a planographic master, although as in the other described methods of master formation, a solution must be applied to convert the nonimaged normally ink receptive areas of the aluminum substrate to an ink repellant or releasing condition, to thus provide a background for the relatively ink receptive, deposited toner image. After alteration of the nonimage areas, the plate is then wetted with an ink which is preferentially accepted by the toner image and released by the converted hydrophilic nonimage areas.

It may, therefore, be seen that regardless of the means of imaging the planographic master, the printing system is completely dependent on the concept that a film of water which is coated over nonimage areas of a printing master, being cohesively weak will reject an oleophilic or oil based ink. In this manner, the printing apparatus of the planographic variety, particularly of the offset type, necessitates the presence of various mechanical equipment for separate application of water based "fountain solution", as well as inks to the imaged master, incuding equipment to store these materials in adequate quantity for continuous operation, meter them as required during the process of the printing, transport them from the storage space to the printing image carrier, and distribute them properly as films to the surface of the image carrier. It may, therefore, be seen that a large amount of equipment is required to simply fulfill this function to say nothing of maintaining the delicate balance which exists between the mutually repellant ink and fountain solution thus creating numerous physical problems in metering and handling, both of which are constantly changing over the period of the printing run. Associated with this, are difficulties in maintaining proper consistency of the fountain solution, and preventing the ink from emulsifying by "backflow" of the fountain solution into the inking rollers during machine operation, as well as flowing of the fountain solution onto the offset cylinder, thus moistening the image receiving sheet causing it to curl and change dimension. Therefore, the formulation of the "fountain" solution referred to above, for overcoming some of these problems has become a difficult and demanding art. Planographic printing, therefore, in spite of numerous advances made therewith, is still largely dependent on operator skill in controlling the balance between ink and fountain solution, both initially and during the constantly changing conditions of the printing run. Furthermore, as opposed to complete elimination of the fountain solution, most advances in the art have been directed towards means of applying the fountain solution, or in controlling the application of it to overcome complete dependency on the skill of the operator to solve the attendant problems.

A different approach to overcoming the problems with fountain solutions other than the above, which is promulgated in U.S. Pat. Nos. 3,511,178, 3,667,178 3,606,922 and 3,632,375 involves complete elimination of the need for a fountain solution or for the application of "water" to release the ink in nonimage areas. This is accomplished by using a described "abhesive" background for the ink receptive image which is substantially ink repellent without regard to whether or not it is impregnated with aqueous fountain solution. This "abhesive" background which is repellent to the printing ink actually keeps the ink from splitting away and transferring from the inking rollers, thus obviating a need for the fountain solution to repell the ink. This type of planographic system has therefore been characterized as a "dry" or "waterless" planographic printing system. The "abhesive" background in plates of this type is provided by cured silicone gums or silicone elastomers, which when "dry" i.e. without being wetted by water, will not accept printing ink from an inking roller in contact therewith. On the other hand, although the need for fountain solutions has been obviated by "adhesive" materials of this type, nevertheless, a plate which utilizes these materials to provide ink repellent areas presents imaging problems, since the very properties of the silicone elastomer which prevents the ink from adhering to its surface also acts to prevent particulate image patterns such as toner image patterns from readily adhering to the surface thereof. Thus, the procedures normally available to sensitize lithographic masters are not suitable for planographic plates having a cured silicone elastomer coating, since various diazo sensitizers or photographic developers do not adhere well to such a surface. Therefore, the above patents for the most part, overcome this problem, by constructing multi-layered structures with a photosensitive layer between or overlying an abhesive layer. In this manner, upon light exposure, exposed photosensitive image areas can either remain in a soluble form which is easily abraded or washed off, or be converted to an insoluble form with the nonimage areas being removed. In this manner, the substrate becomes exposed in areas where removal takes place providing ink receptive areas, against the ink repellent elastomer background.

Any of the imaging systems which have heretofore been proposed with this type of planographic plates, employs photographic techniques which necessitate either additional mechanical or chemical treatment, as well as extremely long exposure times to produce an image. This not only reduces the speed involved in a complete printing operation, which includes preparation of the master, but requires the use of a planographic plate that must be carefully constructed to have a photosensitive layer, an abhesive layer and a means for securing adhesion between these two layers, in order to provide for proper imaging as well as a long life in continuous printing.

Considering the methods of imaging, available for reproduction, electrophotography and related techniques offer an advantage of simplicity photosensitivity, and speed, which are generally unavailable to conventional photographic imaging techniques. It would therefore be highly desirable if imaging techniques of this type could be adapted to provide ink receptive image areas for adhesive ink releasable elastomers of the type noted above. In this manner, production of printing masters could be greatly simplified, thus eliminating the need for complex photographic techniques in plate production. For example, since electrophotographic images are "developed" with toner particles, on a photoreceptive surface, this "developed" electrostatic image could be in principle easily transferred to an adhesive surface to provide a printing master, thus eliminating the need for any type of photosensitive layer in the adhesive coating for image formation. Such a transfer, however, is difficult to accomplish since as noted above, the properties of the abhesive elastomer which prevents ink from adhering to its surface, also resists adhesion of a particulate image pattern and accordingly the transfer of a developed electrostatic image to an elastomeric surface presents unusual problems that the ordinary image receiving surface would not.

Among the methods proposed for overcoming the reluctance of an ink releasable surface to adhere to developed electrostatic image and retain the applied image in a manner which permits the use of the imaged member as a printing master, are those described in U.S. Patent Application, Ser. No. 351,041 by Richard Crystal and Ser. No. 351,129 by Richard Crystal both filed Apr. 13, 1973. Both of these cases involve the use of an uncured silicone gum on a substrate. In this manner, the developed electrostatic image adheres to the uncured silicone gum, which is then converted to a tough, ink releasable silicone elastomer thereby providing ink releasable non-image areas suitable for printing operations.

In U.S. Ser. No. 351,041, the adhered particulate image pattern after fixing to the uncured silicone remains to provide ink receptive sites or can be fixed into the silicone layer, thereby creating a permanent image of ink receptive characteristics. In U.S. Ser. No. 351,129, an adhered particulate image is fixed to the silicone gum and coalescence of the particulate image is avoided during curing, to retain the particle geometry of the applied image pattern. Following this, the individual particles are removed, thereby revealing a porous ink receptive image in the silicone elastomer. The ink receptive image is induced by the varying geometry and sizes of the individual particles. These particle induced "footprints" are then made permanent in the layer by curing of the silicone gum. In either case, the resultant ink receptive image areas, and the background areas which have been cured to a non-tacky ink releasable condition provide a printing master when inked which is highly suitable for a continuous printing operation, without a need for treatment of the master with fountain solution to prevent the ink from printing in background areas of the final copy.

While the above described methods represent meaningful improvements in the production of printing masters, the present invention is directed towards a further means of utilizing an particulate image pattern such as that derived from a developed electrostatic image for the provision of ink receptive image areas on ink releasable surfaces.

It is therefore an object of the instant invention to provide a novel imaged, printing master suitable for printing purposes, particularly planographic printing.

It is also an object of the instant invention to provide a method of producing such a printing master, having an ink releasable surface and useful in printing applications.

Another object is the inclusion on the printing master having an ink releasable surface, of an image which is ink receptive and capable of use in planographic type printing applications.

Still a further object of the instant invention is the provision of imaging the printing master having an ink releasable surface with a developed electrostatic image, thereby providing an imaged master which is capable of planographic reproduction.

Another object is therefore the provision of an offset or direct lithographic printing process which eliminates the need for an aqueous fountain solution to provide ink release in nonimage areas of the master.

SUMMARY OF THE INVENTION

The present invention involves a method for producing a novel printing master which comprises; coating a suitable substrate with a layer of an ink releasable material having incorporated therein an activating proportion of a "blowing" or "foaming" agent followed by the application of a particulate image pattern to the ink releasable surface. The ink releasable layer specifically comprises an uncured silicone gum, which permits adherence of the particulate image pattern. Thereafter, the ink releasable material is cured to a non-tacky ink releasable condition during which the "blowing" or "foaming" agent is activated, either by the conditions of curing or other stimuli. The ink releasable layer typically comprises silicone gums which are cured to ink releasable silicone elastomers. These gums are surprisingly permeable to gases or vapors before and after curing to an elastomeric condition. Therefore, when the incorporated "blowing" or "foaming" agent is activated and at least partially vaporized, the relatively permeable silicone gum permits escape of the vaporized material in the nonimaged areas while in the imaged areas, corresponding to the deposited particulate image pattern, the image pattern prevents the vaporized material from escaping thereby entrapping it in the silicone layer. Since curing of the gum is carried out either simultaneously with or shortly after activation of the blowing agent, the foaming or blowing effect created by the blowing agent is stabilized or fixed in the ink releasable layer. The particulate image pattern is then removed, revealing a vesicular or "foamed" image corresponding to the particulate image pattern which is ink receptive and thereby suitable for printing. These ink receptive image areas in the ink release layer provide a printing master when inked, which is highly suitable for a continuous printing operation without a need for treatment of the master which fountain solution or aqueous solutions of this type to prevent the ink from printing in the background areas of the final copy.

The resultant imaged printing master, thereby differs from the prior art printing masters employing ink releasable surfaces to provide background areas, in that there is no dependence on having a multi-layered and complex structure of alternating, ink release, photosensitive, and anchoring layers, as well as photographic techniques for the imaging thereof. Furthermore, an even more surprising difference is that the resultant ink receptive, vesicular image areas of the printing members of the instant invention have so called "abhesive" properties or release values which are remarkably similar to those of resultant ink releasable non-image areas, as measured by the "adhesive" release test, as defined and disclosed in U.S. Pat. No. 3,511,178. There is, therefore, a distinction over the prior art in this respect since the ink receptive image areas referred to therein typically have adhesive release values more than ten times that of the ink releasable non-image areas.

DESCRIPTION OF THE PREFERRED EMBODIMENTS

Figure 1:
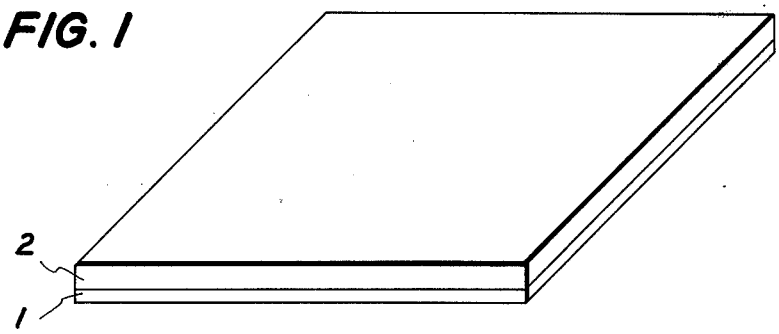
FIG. 1 depicts the formed printing master of the instant invention and its structure.

Referring specifically to FIG. 1, the printing master and method of producing the same comprises a suitable substrate 1, which can generally be most any type of self supporting material including metal, plastics, paper, etc., examples of which include aluminum, and other metals, polyester, polycarbonate, polysulfone, nylon and other relatively heat stable polymeric materials. The only functional requirements for the substrate being that, it provides for sufficient adherence of the applied ink release layer, as well as possess sufficient heat and mechanical stability to permit use under widely varying printing and handling conditions. The present invention is therefore not intended to be limited insofar as specific materials which are suitable for the substrate provided that it meets the above noted functional conditions.

The substrate is then coated with a layer of an ink release material 2, which for the purposes of the present invention is specifically characterized as an uncured silicone gum. This material after application is somewhat tacky at ambient temperatures, but can thereafter be converted to an essentially nontacky tough elastomeric surface which also provides ink releasability.

Among the various types of materials, which are preferred and suitable as the ink release surface 2 of the present invention, are the silicone gums. These materials are linear uncrosslinked polymers, which adhere readily to various surfaces and can be crosslinked or cured to a non-tacky tough rubbery silicone elastomer. These elastomers have ink release properties to provide background ink releasing areas for ink receptive images without the need for aqueous solutions to provide ink release, as well as having superior mechanical properties for use in printing. For purposes of the present invention, these silicone gums are applied to the substrate and thereafter left in an uncured condition to permit adherence of a deposited particulate image pattern and thereafter crosslinked to a tough ink releasable silicone elastomer. Although the silicone gum could be characterized as in ink releasable material, nevertheless its properties which permit adherence of a toner or particulate image also makes it mechanically unsound for printing thereby necessitating that it be cured to a tougher elastomer which is also ink releasable.

The term "cured" is meant to refer specifically to the material in a crosslinked condition or the chemical connection of adjacent linear polymer chains by means of a crosslinking species. The density of crosslinking of the polymer can, of course, vary, with this intended to refer to the number of monomer units in the polymer from which crosslinks originate in relation to the total number of monomer units. Two general methods are involved in the curing or crosslinking of silicone elastomers the first of which is the incorporation of a curing agent into the silicone gum composition and then activating the curing agent through the application of heat. Elastomers cured by this type of process are referred to as heat cured or thermosetting elastomers.

Typical curing materials include either catalytic materials such as organic peroxides to stimulate the production of reactive sites on the polymer, or various reactive species which can participate in a stoichiometric reaction with the copolymer units, included among which are various types of blocked diisocyanates. The second general method of curing silicone elastomers is by carrying out the curing at ambient temperature and under atmospheric conditions thus requiring the incorporation of certain materials in the silicone gum to achieve this purpose. Elastomers of this type are generally referred to as room temperature vulcanizable or RTV elastomers. The resultant silicone elastomers cured by either process, as well as suitable mixtures thereof, have been found to provide a suitable ink releasing background for the master of the instant invention, permitting adherence of a deposited particulate pattern image and thereby yielding a printing master of highly desirable printing characteristics.

The uncured or substantially uncrosslinked silicone gum is preferably applied to the substrate by solvent casting techniques including dip coating, draw bar coating, etc. Following dissolution in organic solvents, which typically may be solvents such as benzene, hexane, heptane, tetrahydrofuran, toluene, xylene, as well as other common aromatic and aliphatic solvents, with the particular solvent employed depending on the silicone gum which is to be solubilized, curing agents to be added, etc.

The thickness of the ink release layer will, of course, vary depending on the choice of materials, as well as any particular mechanical properties desired, and the present invention is not intended to be limited in this respect. Typically, however, this layer will have a thickness of between about 0.1 and 50 microns.

An essential element of the silicone gum composition that is applied to the substrate in the instant invention, is a "blowing" or "foaming" agent, which is at least partially vaporized during curing of the silicone gum to an elastomeric condition. The vaporized agent creates a "foaming" effect in image configuration, since the deposited image particles or fused image derived from the particles, prevent the vaporized material from escaping out of the relatively permeable silicone gum, thereby entrapping the vaporized material and foaming the silicone material in image configuration. The foamed structure is then chemically stabilized by curing of the silicone gum thereby creating, after removal of the particles, a vesicular image of ink receptive characteristics. Accordingly, the use of a vaporizable material such as "blowing agent" to enhance foaming in image configuration is achieved in a manner similar to that employed in foaming thermoplastic materials such as urethanes or materials of this type in which small discontinuities or cells in a fluid or plastic phase are created, which are then caused to grow to a prescribed volume followed by stabilization of the cellular structure by physical or chemical means. "Foaming" is the primary physical effect involved in formation of the ink receptive image in the instant invention. In the instant case, the image will prevent escape of the volatized blowing agent as readily as the particulate image pattern and the "geometry" of the particles does not control formation of the ink receptive image areas.

Specifically in the instant invention, an uncured silicone gum composition has dispersed therein a vaporizable component, or blowing agent which can be at least partially vaporized in response to an activating energy source, i.e. thermal, microwave or actinic radiation. Following deposition of a toner pattern in imagewise configuration to the uncured silicone, the "blowing" effect of the vaporizable component is achieved by subjecting it to the activating energy sufficient to at least partially vaporize it, while at the same time chemically stabilizing the structure by curing of the gum to an elastomeric condition. It is believed, that the toner or particulate image being somewhat impervious to the vaporized gas "caps" the image areas and prevents the gases escape from the silicone layer, thereby trapping and foaming the silicone layer in image configuration, while the silicone in the nonimage areas having nothing to entrap the vaporized component, and being relatively permeable to the vaporized component permits the vaporized component to escape thereby creating a foamed, ink receptive image against a smooth ink releasable silicone background area.

The specific blowing agents suitable for use in the instant invention primarily depend on the specific means intended for achieving the vaporization thereof. Specific blowing agents recognized in thermoplastic foaming technology for this purpose, and suitable for the formation of foamed plastics are suitable for use in the instant invention and the present invention is not intended to be limited in this respect.

Typical blowing agents which can be activated by thermal means include materials such as ethylene carbonate, N,N'-dinitrosopentamethylene tetramine, sulfonyl hydrazides such as benzene sulfonyl hydrazide, 4,4'-oxybis(benzene sulfonyl hydrazine), urea oxalate, and other oxalate salts of organic bases, sulfonyl semicarbazides, N-substituted 5-amino-2,3,4-triazoles. Blowing agents which can be activated by actinic radiation specifically such as ultraviolet radiation, include various diazo and azido compounds, which decompose to a gaseous component upon exposure to ultraviolet radiation, thereby foaming the silicone gum in imagewise configuration. Typical blowing agents of this type include the azido compounds such as 2-carbazido-1-naphtol, azidophthalic anhydride, ethylene bis(4-azidobenzoate), 4-azido-B-nitrostyrene, 4-azidoacetophenone and 2-(4-azidocinnamoyl)thiophene. Examples of typical diazo compounds include the following, N,N-dimethyl-aniline-4-diazonium chloride-zinc chloride double salt, p-dizaodiphenylamine sulfate, p-diazo-N-ethyl-N-hydroxyethylaniline chloride-zinc chloride salt, p-diazo-N-ethyl-N-methylaniline chlorate-zinc chloride salt, 1-diazo-2-oxynapthalene-4-sulfonate, p-diethylamino-benzenediazonium chloride-zinc chloride, 4-benzoamino-2,5-diethoxybenzene diazonium chloride, p-chlorobenzenesulfonate of 4-diazo-N-cyclohexylaniline, p-chlorobenzenesulfonate of 4-diazo-2-methoxy-1-cyclohexylaminobenzene, tin chloride double salt of 4-(N-methylcyclohexylamino) benzenediazonium chloride, p-acetimidobenzenediazonium chloride, 4-dimethylaminobenzenediazoniumchloride, 4-(N-morpholino)benzenediazonium chloride, 4-(N-piperidyl)-2,5-diethoxybenzenediazonium chloride, 1-diethylaminonapthaline-4-diazonium chloride, and 4-phenylaminobenzenediazonium chloride.

In addition to the above-described materials which decompose in response to activating radiation, other blowing agents may be employed. The specific amount of "blowing" or "foaming" agent to be added to the silicone gum composition is not intended to be limiting insofar as the present invention since this will be highly dependent on the type of blowing agent, and the activating means for the agent. Therefore, an activating proportion of any type of "blowing" agent generally recognized in the art for thermoplastic foaming is readily apparent to one skilled in the art dependent on his choice of blowing agent and activating conditions. It is, however, preferred that such an excess not be added so as to create a substantial residue of inactivated "blowing" agent in silicone elastomer, since it is possible in some instances that this might affect the ink release properties of the elastomer during printing. Typical percentages for the blowing agent can range from between about 0.01% to 5% by weight of the composition.

Figure 2:
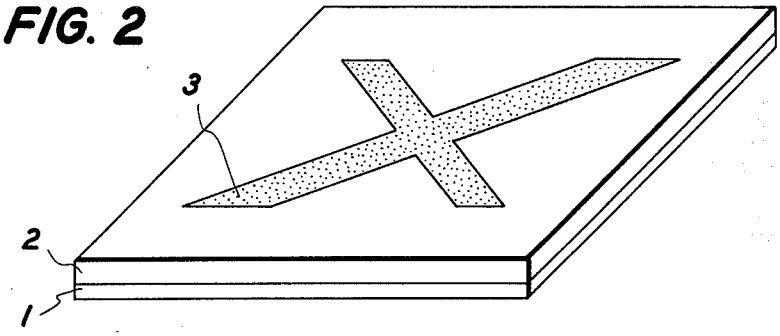
FIG. 2 depicts the printing master of the instant invention imaged with a deposited particulate image pattern.
Figure 3:
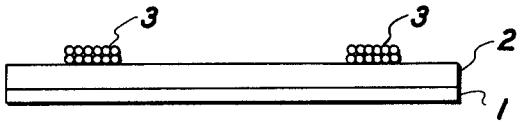
FIG. 3 shows a side view of the printing master of the instant invention after the particulate image pattern is applied.

Following application of the silicone gum composition to the substrate, and with particular reference to FIGS. 2 and 3, a particulate image pattern such as a toner image pattern 3 is deposited on the surface of the ink releasable layer 2, said image pattern corresponding to that of a latent electrostatic image, which is preferably developed on a separate photoconductive surface and transferred to the ink releasable surface. The method of forming the deposited particulate image pattern can, of course, be achieved by a variety of techniques including electrophotography which comprises the electrostatic charging of a photoconductive insulating layer, followed by exposure to a pattern of activating radiation such as light, which selectively dissipates the charge in the illuminated areas of the photoconductive insulating layer while leaving a latent electrostatic image in the non-illuminating areas. This latent electrostatic image may then be developed to form a visible image by depositing finely divided electroscopic marking particles on the surface of the photoconductive insulating layer. Other means of forming the resulting particulate image pattern for imaging of the ink releasable surface include photoelectrophoretic imaging as generally described in U.S. Pat. No. 3,384,566, U.S. patent application, Ser. No. 104,398, filed Jan. 6, 1971, and U.S. patent application, Ser. No. 104,389 filed Jan. 6, 1971, which is now abandoned, as well as migration imaging techniques as set forth in U.S. patent applications Ser. Nos. 837,591 and 837,780, both of which were filed June 30, 1969, may also be employed to yield a particulate image pattern which can be applied to the ink releasable surface and thereby provide image areas therein for printing purposes.

Insofar as development of the electrostatic image, means of development will be dictated by the particular imaging technique, but insofar as conventional xerography, cascade development as set out in U.S. Pat. Nos. 2,618,551 and 2,618,552, powder cloud development as described in U.S. Pat. Nos. 2,725,305 and 2,918,910 and magnetic brush development as in U.S. Pat. Nos. 2,791,149 and 3,015,305 may, of course, be employed.

The present invention is not intended to be limited insofar as the specific type of particulate material used to develop the latent image, and any conventionally known toner can be conveniently employed, including those described in U.S. Pat. Nos. 2,788,288, 3,079,342 and Re 25,136, these typically comprising various styrene polymers, copolymers, and various other types of thermoplastic materials. Other types of particulate materials are suitable without regard to their composition, provided they are not themselves permeable to the generated gases.

The silicone gum being in a somewhat tacky state picks up and adheres the deposited particulate image pattern in image configuration. If the image pattern is transferred to the relatively tacky silicone gum from an adjacent photoconductive surface, it is preferable that the photoconductive material have a surface which is non-compatible with the silicone gum and which prevents adherence of the gum thereto, otherwise the photoconductive material can be damages besides also disrupting the characteristics of the image pattern on the silicone gum. One means of accomplishing this, although the following is not intended to be limiting, includes having the photoconductive surface coated with a releasable material provided that it does not interfere with the photoconductive properties of the surface. Typical materials for this purpose include fluorocarbons such as polytetrafluoroethylene, polydimethylsiloxane elastomers, polyethylene, polypropylene or similar materials. If it is not possible to coat the photoconductive surface, transfer of the particulate image from the photoconductive surface may be made to a "release type" intermediate image receiving member which subsequently provides contact with both the tacky silicone gum as well as the photoconductive surface. In this manner, a wider range of coatings can be employed to prevent adhesion of the silicone gum to the transfer surface while transferring the particulate image pattern. These include the use of lubricated surfaces carrying silicone oil or hydrocarbons as well as water bearing surfaces such as gelatin or other swelled polymers, in addition to using low adhesion polymeric materials such as those noted above. In any event, the manner of overcoming this problem is not deemed to be critical to the production of the printing master of the instant invention and the particular means individual may be readily perceived by one skilled in the art.

Figure 4:
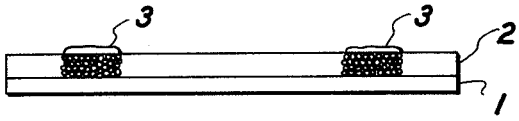
FIG. 4 shows a side view of the printing master of the instant invention after curing of the ink release layer and activation of the added blowing agent are carried out.

With reference to FIG. 4, the following deposition of the particulate image pattern 3 to the silicone gum composition 2 having the added "blowing" agent, the blowing agent is activated at the same time that curing of the silicone gum is carried out to convert the gum to elastomeric condition as well as chemically stabilize the "foaming" effect created by the activated blowing agent. Activation of the blowing agent is carried out by the appropriate stimuli, such as heat or actinic radiation. Specifically, if actinic radiation is employed as the activating source, reflex exposure of imaged member may be desirable unless, the particulate image pattern is transparent to the actinic radiation employed.

Conversion of the gum to a silicone elastomer and the manner it is achieved depends on the specific gum composition. In the instant invention, if the particulate material comprises meltable or fusable materials such as thermoplastic toners, coalescence need not be avoided since either the "fused" image or the particulate image serves to prevent escape of the activated blowing agent. Therefore, the curing conditions for the silicone gum may be carried out without regard to whether or not fusion of the particulate image pattern occurs. Although the gums referred to as the RTV silicone gums, are suitable for use in the instant invention, including mixtures with various thermally curable silicone elastomers, it is nevertheless preferred that the silicone gums to be used in the instant invention be converted to an elastomeric condition through the application of heat. The gum composition can therefore comprise thermally curable silicone elastomers or mixtures thereof with various types of the RTV silicone elastomers.

Typical silicone gums which are of the heat curing or thermally curable type suitable for use in the instant invention include Y-3557, and Y-3602 silicone gum available from Union Carbide Company, New York, New York, as well as No. 4413 silicone and No. 4427 heat curable silicone gums available from General Electric Company, Waterford, New York. Other typical materials which are suitable include Dow Corning S2288 silicone gum, available from Dow Corning, Midland, Michigan. The Y-3557 and Y-3602 gums specifically have aminoalkane crosslinking sites in the polymer backbone which react with a diisocyanate crosslinking agent over a wide range of temperature and time to produce a durable, ink releasable elastomeric film. The time and temperature relationship for crosslinking of all of these different types of gums is controlled by the chemistry of the crosslinking agent employed and a large choice of agents are available for this purpose. The present invention is therefore not intended to be limited with respect to either time or curing temperature of these materials, or the specific materials used to achieve crosslinking, although heating at temperatures between about 50° C and 300° C will typically cure or convert the silicone gum to an ink releasable silicone elastomer.

In the event, the RTV silicone gums are employed singularly or in a mixture with a thermally curable gum, typical RTV gums which are suitable include RTV-108, 106, 118 silicone gums available from General Electric Company, Silicone Products Division, Waterford, New York. These gums are essentially tacky for a short period of time, and capable of thereafter being cured to a crosslinked elastomeric state by standing at ambient temperatures and with exposure to the atmosphere.

Any of the above described silicone gums are not dependent on having a specific density of crosslink sites on the polymer, these being capable of variation over a wide operative range and the present invention is not intended to be limited in this respect.

Figure 5:
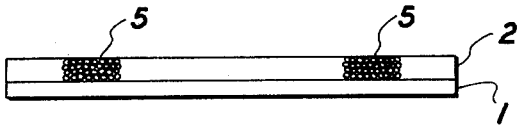
FIG. 5 shows a side view of the printing master of the instant invention after removal of the particulate image pattern.

In reference now to FIG. 5, after the particulate image pattern is fixed by curing of the gum to an elastomeric condition, removal of a substantial number of the particles or of the fused image is carried out, thereby leaving the "foamed" areas 5 exposed. These have been chemically stabilized by crosslinking or curing of the silicone gum, thereby creating a vesicular image 5 in the layer corresponding to the deposited particulate image pattern.

The particles or fused image pattern can be removed in a variety of ways including dissolution, evaporation, abrasion, etc. and the present invention is not intended to be limited in this respect. Specifically, dissolution, of the particles or fused image with appropriate solvents is, of course, the method of choice and within this method is included the concept of using certain inks containing appropriate solvents to dissolve the particles as well as simultaneously ink the plate for printing. The use of inks to remove the particles during printing eliminates the need for a separate operation for removal of the toner particles. The particular solvents used for this purpose will, of course, vary depending on the specific composition of the toner particles, as well as its effect on the silicone elastomer since the solvent should not otherwise disturb or disrupt the ink release properties of the elastomer, and it is therefore apparent that the choice of solvent may be easily determined by experimentation. Typical solvents which have been found suitable for most of the conventional thermoplastic toners include acetone, isopropanol, methyl ethyl ketone, and other common aromatic and aliphatic solvents, all of which remove a substantial number of the integral particles thereby exposing the chemically stabilized ink receptive "foamed" image areas.

The "foamed" image, is surprisingly ink receptive in that when the resultant master with the foamed image areas is inked, it readily accepts ink in these areas. Again, while the present invention is not intended to be limited to a particular theory of operation, it is theorized that the foamed image accepts ink by kind of a "micro pipetting" type of action, rather than by selective wetting as in conventional lithography. The nature of the foamed image areas could thus enable them to absorb a variety of liquids in a compression/relaxation cycle without dependence on wettability characteristics of the image structure. Indeed, this view is substantiated by the ability of the vesicular image areas of the instant printing master to accept diverse types of printing ink including oil based, water based, glycol based, and rubber based ink. An image is therefore provided against an ink releasable background which can be employed with many types of ink, thus differing drastically from prior art lithographic printing processes which were based exclusively or singular use of either an aqueous or oleophilic ink, depending on the type of fluid used to provide ink release in non-image areas. Therefore, insofar as use of the master of the instant invention in printing operations, it is not intended that a limitation exist as to the type of ink useful with the master, since as noted above, the unique characteristics of the image area makes it ink receptivity not dependent on the type of ink employed. Typical inks falling in any of the above categories which are suitable include those generally described in Printing Ink Technology by E. A. Apps, (1959) Chemical Publishing Company, New York, New York.

The "imaged" printing master may thereafter be employed in a planographic printing operation including direct or offset lithography with the dampening system removed, following the inking thereof, and employed in a continuous printing operation to provide good quality prints over a long period of operation. The printing master of the present invention therefore obviates some well known difficulties with prior art printing masters suitable for direct lithography since the imaged masters were not generally resistant to mechanical abrasion thereby making them suitable only for offset lithography, where the image carrier was not directly contacted with the final copy surface. The masters of the instant invention are eminently suitable in direct as well as offset modes of printing, since the ink releasable layer is mechanically sound, and resilient enough to permit continuous use in a direct mode of operation without degradation thereof. Furthermore, the applied image areas possess sufficient mechanical strength to permit use in a direct mode of printing. Inking of the master during continuous operation can thereafter be conventionally carried out with any suitable type of inking device in a conventional direct or offset lithographic apparatus.

The ink release layer of the printing master of the instant invention thus provides background areas or non-image areas which are not in anyway dependent on the application of an aqueous fountain solution to prevent printing in the background areas and because of this, the resultant printing master is capable of operating in a continuous printing mode in an offset or direct lithographic printing device without dependency on a dampening system for the apparatus.

Having thus generally described the instant invention, the following examples describe the instant invention in terms of more specific embodiments although the following examples are not intended to be limiting insofar as the scope of the instant invention.

EXAMPLE I

A printing master was prepared as follows: an aluminum sheet 10 inches × 15 inches was film coated with a draw bar with a 10 percent weight solution of Dow Corning S-2288 silicone gum available from Dow Corning Corporation, Midland, Michigan in heptane:-chloroform (100:4) containing about 0.5 percent by weight of an ethylene carbonate blowing agent. The coating was allowed to air dry to remove the solvent, leaving a layer with a thickness of between about 5 and 8 microns.

Thereafter, using a Xerox Model D Processor, a latent electrostatic test image containing line copy was cascade developed with Xerox 364 toner after which the developed image was transferred from the photoconductive surface to a sheet of paper coated with a Teflon spray. This sheet with the developed image was then contacted with the uncured silicone surface, and the developed image electrostatically transferred to the uncured silicone surface.

The plate was then placed in an oven and heated at 300° C for about 2 minutes. Following this the entire plate was acetone washed to remove all toner particles from the image areas, thereby revealing a vesicular image corresponding to the deposited toner patterns, with noticeable foaming having been accomplished in the image areas. The background areas, however, were substantially unaffected. Following this, the plate was attached to a Davidson Offset Press with the aqueous dampening system removed, inked with Pope and Gray No. 2441 oil based lithographic ink, and in an offset mode of operation copies were made, all of good quality and good reproductions of the applied image.

EXAMPLE II

A printing master was prepared as follows: an aluminum sheet 10 inches × 15 inches was film coated with a 10% solids solution of No. 4427 silicone gum available from General Electric Company, Waterford, New York having included therein 0.5 grams of a 2,2'-azobis(2-methylpropionitrile) blowing agent. The coating was allowed to air dry to remove residual solvent leaving a layer with a thickness between about 5 and 8 microns.

Thereafter, using a Xerox Model D Processor, a latent electrostatic test image containing line copy was cascade developed with Xerox 364 toner after which the developed image was transferred from the photoconductive surface to a sheet of paper coated with a Teflon spray. This sheet with the developed image was then contacted with the uncured silicone surface and the developed image was electrostatically transferred to the uncured silicone surface.

The plate was then placed in an oven and heated at 300° C for about 2 minutes. Following this, the entire plate was acetone ashed to remove all toner particles corresponding to the deposited toner pattern, with noticeable foaming having been accomplished in the image areas. The background areas of the plate were substantially unaffected. Following this, the plate was inked with Pope and Gray No. 2441 oil based ink and prints of good quality were made.

Having described the present invention with reference to these specific embodiments, it is to be understood that numerous variations may be made without departing from the spirit of the present invention and it is intended to encompass such reasonable variations or equivalents within the scope, limited only by the appended claims.

What is claimed is:

1. A method of producing a printing master comprising:

a. providing a suitable substrate, b. coating said substrate with a layer of an uncured silicone gum composition, said composition containing an activating proportion of a blowing agent, c. depositing a particulate image pattern on said layer, d. curing said layer to an ink releasable condition, whereby said blowing agent is activated causing blowing in said image areas, and e. removing particles from said image pattern to reveal ink receptive foamed image areas corresponding to said deposited image pattern.

2. A method as set forth in claim 1 wherein curing is carried out by heating of said silicone gum.

3. A method as set forth in claim 1 wherein removal of said particles is carried out by dissolution of said particles.

4. A method as set forth in claim 1 wherein the uncured silicone gum is selected from the group consisting of room temperature curable silicone gums, heat curable silicone gums, and mixtures thereof.

5. A method as set forth in claim 1 wherein said blowing agent is present in an amount of between about 0.01 and 5% by weight of said composition.

6. A method as set forth in claim 1 wherein said particulate image pattern is fused during curing of said layer.

7. A method of producing a printing master comprising:

a. providing a suitable substrate, b. coating said substrate with a layer of an uncured silicone gum composition, said composition containing an activating proportion of an untraviolet radiation sensitive blowing agent, c. depositing a particulate image pattern on the surface of said layer, d. curing said layer to ink releasable condition, while said blowing agent is activated by exposure to ultraviolet radiation causing blowing in said image areas, and e. removing particles from said image pattern to reveal an ink receptive foamed image areas corresponding to said deposited image pattern.

8. A method as set forth in claim 7 wherein curing is carried out by heating of said silicone gum.

9. A method as set forth in claim 7 wherein removal of said particles is carried out by dissolution of said particles.

10. A method as set forth in claim 7 wherein the uncured silicone gum is selected from the group consisting of room temperature curable silicone gums, heat curable silicone gums, and mixtures thereof.

11. A method as set forth in claim 7 wherein said particulate image pattern is fused during curing of said layer.

12. A printing master having image areas of ink receptivity and non-image areas of ink releasability comprising a substrate, and an overlying layer of an ink releasable silicone elastomer with a foamed image in said layer providing areas of ink receptivity.

13. A method of printing with a printing master having image areas of ink receptivity and nonimage areas of ink releasability comprising a substrate and an overlying layer of an ink releasable silicone elastomer with a foamed image in said layer providing the areas of ink receptivity, comprising applying ink to said image and contacting the master with an image receiving surface to thereby transfer said inked image.

14. The method of claim 13 wherein the silicone is formed from a gum selected from the group consisting of heat-curable silicone gums, room-temperature curable silicone gums and mixtures thereof.

* * * * *